United States Patent [19]

Andersen

[11] Patent Number: 4,667,888

[45] Date of Patent: May 26, 1987

[54] APPARATUS FOR MILLING CEREALS

[75] Inventor: Michael Andersen, Soro, Denmark

[73] Assignee: DeForenede Bryggerier, Copenhagen, Denmark

[21] Appl. No.: 743,907

[22] Filed: Jun. 12, 1985

[30] Foreign Application Priority Data

Jun. 12, 1984 [GB] United Kingdom ..... 8403125

[51] Int. Cl.[4] ..... B02C 7/12

[52] U.S. Cl. ..... 241/76; 241/7; 241/11; 241/261.2; 241/296

[58] Field of Search ..... 241/261.1, 261.2, 79, 241/261.3, 300, 78, 296, 75, 297, 76, 298, 77, 6–11

[56] References Cited

U.S. PATENT DOCUMENTS

| | | | |
|---|---|---|---|
| 238,078 | 2/1881 | Baker | 241/298 |
| 706,259 | 8/1902 | Schweitzer . | |
| 804,738 | 11/1905 | Kreps | 241/298 |
| 934,457 | 9/1909 | McLaughlin . | |
| 1,226,032 | 5/1917 | Van Nostrand . | |
| 1,258,076 | 3/1918 | Woolner, Jr. . | |
| 1,400,123 | 12/1921 | Wolff | 241/298 |
| 1,715,772 | 6/1929 | Mechlin | 241/298 |
| 2,347,215 | 4/1944 | Pattee . | |
| 2,713,977 | 7/1955 | Noll . | |
| 3,761,027 | 9/1973 | Mendoza . | |
| 4,421,772 | 12/1983 | Munck et al. . | |

FOREIGN PATENT DOCUMENTS

| | | |
|---|---|---|
| 88268 | 1/1895 | Fed. Rep. of Germany . |
| 419660 | 8/1981 | Sweden . |
| 419945 | 9/1981 | Sweden . |
| 2088247 | 6/1982 | United Kingdom . |

*Primary Examiner*—Mark Rosenbaum

*Attorney, Agent, or Firm*—Merchant, Gould, Smith, Edell, Welter & Schmidt

[57] ABSTRACT

A method for fractionating milling of cereals between two milling disks having annular working surfaces facing each other and composed of serrated segments, such that the desired fraction, for instance bakery flour, can be recovered by sifting even after a single passage of the milling material between the milling disks. The invention is characterized in that the serrate pattern of said segments comprises a plurality of straight, parallel ridges acting as cutting teeth alternating with parallel grooves and being so designed that the cutting teeth of each segment have a constant height and width and make such an angle with respect to the line of symmetry of the segment that the cutting teeth of each milling disk will intersect the lines of symmetry of each segment of the other milling disk at an angle of $\pm\alpha_1$ for one milling disk and $\pm\alpha_2$ for the other milling disk, such that the first cutting tooth of each segment of one milling disk will intersect the cutting teeth of the other milling disk at angles of intersection K which vary according to the relationship $K=(\alpha_1+\alpha_2)\pm x°$ where $\alpha_1$, $\alpha_2$ is said angle between one cutting tooth of each segment in relation to said line of symmetry $R_x$, and x is the sectoral arc angle of the segment.

11 Claims, 11 Drawing Figures

APPARATUS FOR MILLING CEREALS

BACKGROUND OF THE INVENTION

1. Field of the Invention

The present invention relates to a method for processing cereals, seeds or like products by means of a disk mill into such a state that the botanical constituents of such products are separable by means of sifting devices, and the invention also comprises a plant for carrying out the method.

2. Description of the Prior Art

Before the appearance of roller mills, use was generally made of millstones for milling cereals. In a broad sense, a rotatable millstone with a circular working surface may be regarded as a disk, but no one would hardly contend that our old mills with millstones are disk mills.

Even at the time the old mills with millstones were used, efforts were made to improve the milling efficiency in order to reduce the number of passages required for complete milling, by grooving the working surfaces of the millstones. The breakthrough for roller mills meant a considerable improvement in regard of flour quality, yield and production capacity, however at the cost of a very large plant complexity with substantial investment and operating costs.

At regular intervals, suggestions have therefore been made to replace the complicated and expensive roller mills with fast-operating disk mills which in other fields, particularly in the papermaking industry, have gained a reputation of being relatively uncomplicated and having a high production capacity. U.S. patent specification No. 706,259 (Schweitzer) of 1902 is an early example of the idea of using disk mills for milling cereals. Schweitzer suggested the use of annular milling disks with grooves formed in the working surfaces and arranged in groups in a special manner, the primary feature being that the grooves should be defined by saw-tooth-shaped ridges with sharp edges and a progressive transition from grooves of a large width and a large depth at the inner periphery of the annular milling disks, where the product to be milled is introduced between the disks, to increasingly finer grooves in a direction toward the outer periphery of the disks. The larger grooves at the inner periphery were meant to facilitate the entrance of the material to be milled, and in the region of these larger grooves, the dehulling of the seeds should start, whereupon the processing should proceed to complete milling in the increasingly finer grooves. Schweitzer also suggested that the grooves should be disposed as tangents to a small circle having the same center as the center of the milling disk in order that the angles of intersection of the grooves in two cooperating milling disks with mutually reversed working surfaces should vary in the circumferential direction of the disks. The concept of milling grain to fine flour in a single step with milling disks of this type did not meet with much success. Shortly afterwards, it was however suggested in U.S. patent specification No. 934,457 (McLaughlin) of 1905 to use a very similar type of milling disks for hulling only. This patent specification does however not give any other indication on the idea of the grooves than that they should be more easy to produce, and it is not explained therein why the proposed groove configuration should be better suited for hulling than milling. One might guess that McLaughlin, being aware of Schweitzer's previous milling disks, knew that they were not suited for milling but could be used for hulling.

Many suggestions of providing milling disks with grooves of different types have thereafter been put forth, however with poor results, at least as regards milling of cereals in a single step for producing high-quality flour and at a low cost. K-E. A. Johnsson states e.g. in SE patent specification No. 419,945 as late as 1981 that there is nothing in a disk mill, at a certain speed of rotation and with a certain milling disk type, to affect the pattern of movement and residence time of the milling material between two coaxial milling disks rotating with respect to each other, and setting out from that conviction, he proposed an entirely novel type of milling disks characterized by arranging in a stationary milling disk a series of small, separately driven milling disks mounted rotatably in pockets in the stationary main disk. The milling result of these new milling disks has not yet been evaluated, but obviously these milling disks are complicated and very sensitive to disturbances.

A feature common to all mills with complicated milling surface configuration is the difficulty of correctly assessing the influence of each separate factor among the complex of factors affecting the milling result. A basic condition for appreciating the milling result of course is that the milled product can be analyzed and that the results of analysis can be related back to the different factors which have been decisive of the milling result. It is also of great importance that the analyses can be effected as quickly as possible and in close proximity of the equipment used in each particular case.

As is well known, the botanical constituents of cereals (seeds and kernels) are the starch body (endosperm minus aleurone layer), the germ and the aleurone and hull layers, said two layers being classified as bran. The hull and aleurone layer fractions and the germ fraction may be used, e.g. as animal fodder or as an additive in a certain amount to the flour as an addition to the fiber content and for increasing the mineral and vitamin content of the flour. The hull and aleurone layers and the starch body of the grain or seed kernels are of different hardness and density, and the very milling process serves to break down the grain or seed kernels to such an extent that the resulting particles can be separated into fractions containing the desired percentages of starch, aleurone and hull fractions. For effective milling and separation for producing a high-quality flour with a satisfactory yield, it has hitherto been necessary to carry out both the milling and the sifting operation in several steps. Certain initial successes in the attempts of replacing the roller mills with disk mills aroused hopes that it would be possible to make the equipment on the mill side of a cereal processing plant less complicated than the machine equipment required for milling in roller mills. However, before the conception of the present invention, these hopes have not been redeemed. This has been confirmed by recent, highly improved methods of analysis.

In SE patent specification No. 419,945 mentioned above, the main reason is assumed to derive from the difficulty of affecting the pattern of movement and residence time of the material milled between the milling disks previously used. The present invention sets out from the assumption that a decisive or strongly contributory reason is that it has been considered necessary for a sufficient breakdown in a single mill passage to let the milling material pass radially between milling disks which comprise a plurality of more or less distinct grooved zones where the grooves are of mutually different depth and width. Milling disks comprising two or more grooved zones necessitate greater radial dimensions than a uniformly grooved single zone. The different grooved zones may however be compared to several milling steps, and it is much more difficult, not to say impossible, by adjusting one milling disk with respect to the other, to correctly adjust one annular grooved zone without affecting adjacent annular grooved zones. An improvement of the breakdown between two opposing annular grooved zones therefore tends to be accompanied by a deterioration of the processing between the next or preceding grooved zone. Under such circumstances, it is very difficult to find out the actual reason or combination of reasons giving the poor result.

A most likely reason might be the difficulty to comply with the requirement for an equivalent breakdown of grains or seeds of varying size in a certain charge milled in successive passes between two or more grooved zones where the groove width and groove depth are gradually decreasing in the direction of movement of the material when being milled. Besides, in the disk mills hitherto known and used it is usually necessary frequently to exchange the milling disks even at minor differences between different charges of material to be milled.

One of the objects of the invention is to provide a method of milling cereals by means of a disk mill which comprises a pair of more or less planar milling disks or, optionally, conical milling surfaces which, like the working surfaces of typical disk mills, cooperate over an essential area as opposed to the tangential cooperation which is typical of roller mills, and to overcome by this method the above-indicated shortcomings and limitations of disk mills and to allow unobjectionable milling during a single passage between two milling surfaces of the type described above and rotating with respect to each other. A further object of the invention is to make it possible, by a relatively simple adjustment of the mill, to process different cereal and seed types within the entire range from dehulling to the production of flour with equally high quality and product yield as in milling by means of conventional roller mills, but at a higher production rate and by the use of a machine equipment which is substantially less complicated and less comprehensive than the equipment which is normal for a roller mill.

Yet another object of the invention is to allow such milling of the kind mentioned above in a single passage through the disk mill that the milled material is discharged from the mill sufficiently disintegrated in respect of its botanical constituents to be readily separable by relatively simple methods of separation into fractions having any desired percentage proportion of the botanical constituents of the seed or cereal fed to the mill.

As already mentioned in the foregoing, the present invention sets out from the experience that previously known, pairwise cooperating milling surfaces of the surface-cooperating type, generally the milling surfaces of typical milling disks, do not yield the desired results, especially at single-step milling, because of unsatisfactory groove configurations and do not permit a correct adjustment of the milling surfaces in relation to each other for ensuring the breakdown and release of the above-described botanical constituents with respect to each other, which is desirable before the subsequent sifting operation. Particularly, the invention has for its object to dispense with the use of a grooved zone with large grooves on the inlet side, and increasingly finer grooved zones towards the outlet or discharge side.

A further object of the invention is to provide a milling plant which comprises a disk mill for carrying out the method and by means of which the processing can be carried out in a simple, adjustable manner for each particular degree of breakdown desired from hulling to fine grinding, such that the subsequent separation into desired fractions or fractional combinations can be effected in a particularly simple and efficient sifting device.

These objects have now been achieved by a method and an apparatus according to the invention which have been given the features recited in the claims.

BRIEF DESCRIPTION OF THE DRAWINGS

The method and the apparatus according to the present invention will be described in more detail hereinbelow by way of examples with reference to the accompanying drawings, in which.

DESCRIPTION OF THE PREFERRED EMBODIMENT

Figure 1:
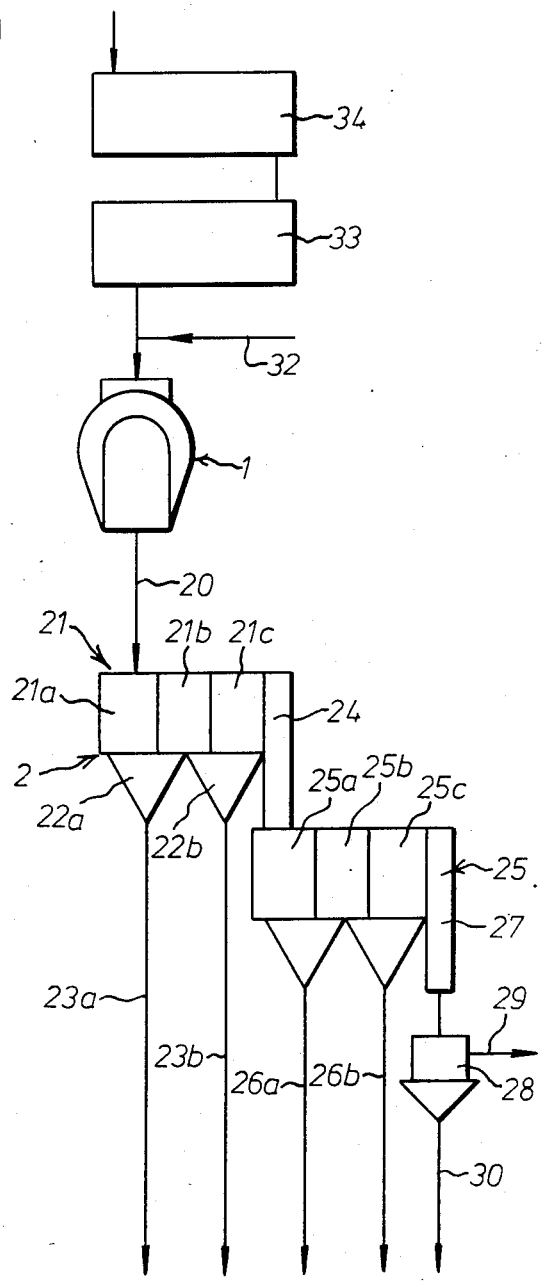
FIG. 1 is a schematic view of a substantially complete milling plant for carrying out the invention.
Figure 2:
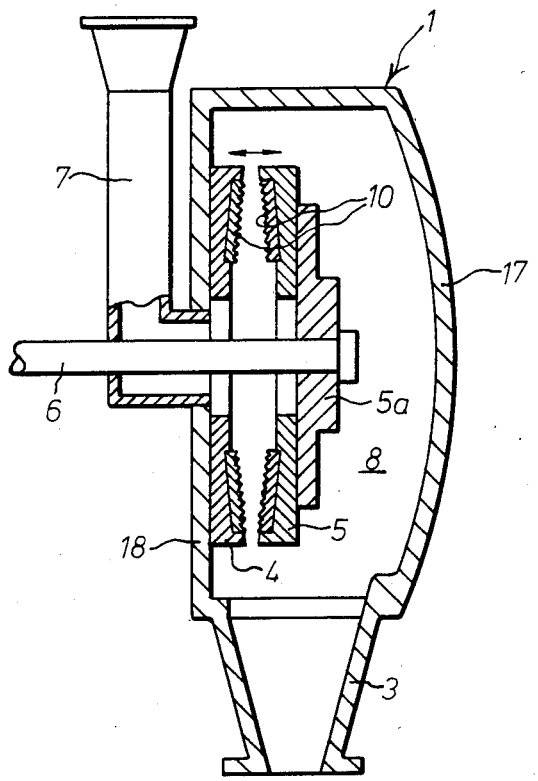
FIG. 2 is a schematic view of a disk mill according to the invention included in the plant of FIG. 1.
Figure 3:
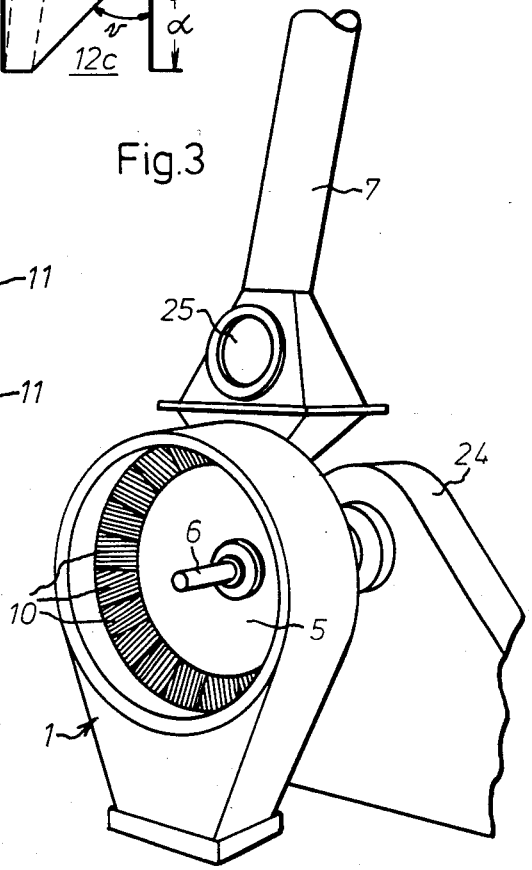
FIG. 3 illustrates the interior of the mill housing wherein is mounted a stationary milling disk, the rotatable and axially adjustable milling disk for cooperation therewith being removed.
Figure 8:
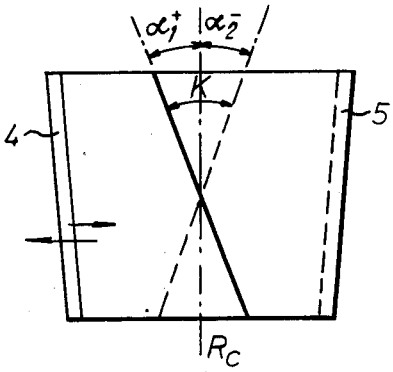
FIG. 8 is a schematic view of the shear angles for and the angle of intersection and the shear and cutting cooperation between two cooperating cutting teeth of two milling segments of the type illustrated in FIG. 7 and shown when cooperating at a certain relative rotary angle.
Figure 4:
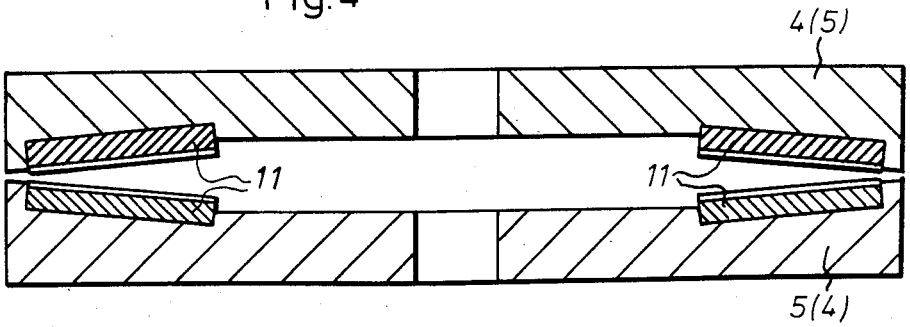
FIG. 4 is a cross-sectional view of cooperating milling disks according to the invention which have slightly conical grooved zones which are facing each other and the conicity of which is illustrated in an exaggerated manner to illustrate how the infeed problem is simply solved in disk mills according to the invention.
Figure 5:
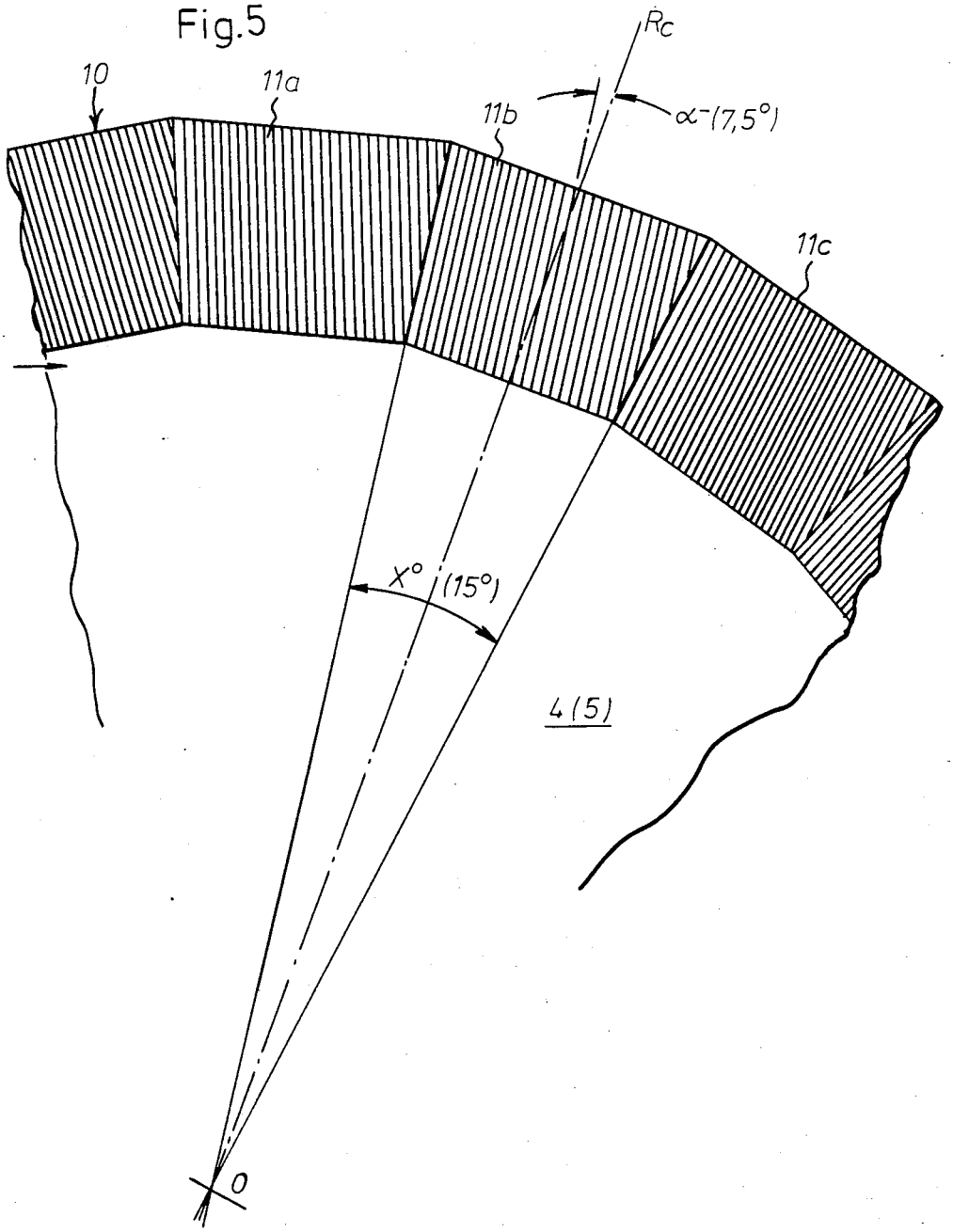
FIG. 5 is a schematic and fragmentary view of the grooved milling surface, composed of assembled segments, of a milling disk according to the invention.

The milling plant illustrated in FIG. 1 comprises a disk mill generally designated 1 and a sifting plant generally designated 2 which is connected to the outlet 3 of the disk mill. The disk mill, shown in greater detail in FIGS. 2 and 3, is provided with a pair of milling disks 4, 5 of which only one is shown in FIG. 3. One milling disk 5 may be rotatable and axially adjustable whereas the other milling disk 4 may be stationary. In FIG. 2, the milling disk 5 is detachably mounted on a plate 5*a* which is rotatable by means of a drive shaft 6.

The drive which preferably comprises an electric motor should be able to drive the milling disk 5 at an adjustable speed and preferably also in reverse directions of rotation.

Optionally, both milling disks may be rotatable at adjustable speeds, and preferably in reverse directions of rotation for one or both of the milling disks.

In the illustrated embodiment, the disk mill is arranged for central feed of the milling material and, therefore, it is equipped with a feed conduit 7 opening centrally into the milling chamber 8 and introducing the material to be milled between the milling disks through a central inlet opening in the stationary milling disk. The milling plant now described is in principle already known per se. The novelty of the disk mill lies in the design and groove configuration of the milling disks.

The construction, groove configuration and cooperation of the milling disks are illustrated in FIGS. 4–7 and will be described hereinbelow.

Characteristic of a milling disk according to the invention is that it has only one annular grooved zone 10 which is located adjacent or at the outer circumferential edge of the disk and is relatively narrow in relation to the radius of the disk and divided into a relatively large number of sectors or segments 11*a*, 11*b*, 11*c*. Another distinctive feature of the preferred embodiment is that the grooves of each segment are parallel and the ridges 12*a*, 12*b*, 12*c* of each segment form equally large angles in relation to the ridges of adjoining segments. Further, in the preferred embodiment, the first ridge as counted in the circumferential direction, such as the ridge 12*a* of the segment 11*a*, is, especially for reasons of manufacture, parallel to a disk radius, and according to the invention the parallel grooves of each segment have equal width and equal depth throughout the entire length of the grooves from the inner circumference of the grooved zone 10 to the outer circumference thereof.

Figure 7:
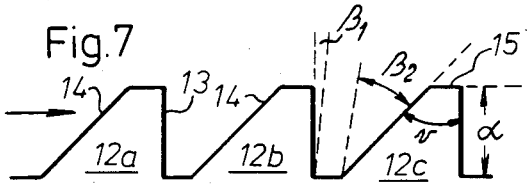
FIG. 7 is a schematic view on an exaggerated scale of one example of the design of the cutting teeth or grooves of a milling disk according to the invention.
Figure 6:
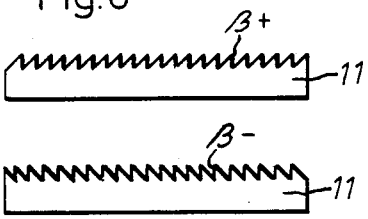
FIG. 6 schematically illustrates two different or reverse cutting or shearing directions of the cutting teeth of two cooperating milling segments.

In principle, the ridges defined by the grooves are of sawtooth-shaped cross-section, as illustrated in FIG. 6, but the sawtooth shape is preferably modified in that the crests of the ridges are planar such that each ridge has such trapezoidal section that also the rear flank thereof is usable as cutting side (see FIG. 7).

The angle v between the cutting flanks and the rear flanks 13 and 14, respectively, the inclination of the flanks in relation to the plane of the disk, and especially the degree and direction of inclination $\beta$ of the cutting flanks in relation to the relative direction of rotation of the disk, as well as the width of the planar crest surface 15 may vary and are important for the milling result.

By selecting the direction of rotation for the rotary milling disk in relation to the stationary disk or, generally speaking, the relative direction of rotation of one disk in relation to the other, it is possible to obtain any one of the combinations cutting flank to cutting flank (S/S), rear flank to rear flank (R/R), cutting flank to rear flank (S/R) or rear flank to cutting flank (R/S), and in a manner similar to that known from milling in roller mills, the angle of intersection of the cutting teeth, i.e. the shear angle, may vary, whereby different milling characteristics can be obtained.

In general or in principle, a movement of the type cutting flank to cutting flank (S/S) yields a coarse-milled product, a movement rear flank to rear flank (R/R) yields a fine-milled product and a movement cutting flank to rear flank (S/R) or rear flank to cutting flank (R/S) yields a medium fine product in milling. However, depending upon the size of the grooves and the adjustment of the disks, these combinations can also be used for dehulling. The number of grooves in the disk, i.e. throughout the entire circumference of the grooved zone, is of course of importance for the milling result and should be selected in consideration of the product (flour, hulled kernels etc.) to be produced.

The ridges defined by the grooves are preferably provided on segments consisting of steel, especially tempered steel, hard metal or ceramic materials, and are connected to the disk body. The number of segments on each disk is of course dependent on the size (arc length) of the segment and the diameter of the disk, but as a guideline it may be mentioned that the invention foresees that the preferred size of each segment in a milling disk within a normal disk diameter range of about 400–600 mm should be so selected that the segment covers 15° of the circumference of the disk. Of course, it should be ensured that an equal distribution is obtained, i.e. that the segments cover equally large angles of the circumference. For the now indicated circumferential angle 15° for each segment, 24 segments can be arranged on each disk.

Further, as a guideline also it may be mentioned that satisfactory results in the milling of cereals for flour production have been achieved with grooved segments having a depth d of the grooves of about 1 mm, a width of the crest surface 15 of each ridge of about 0.3 mm, and a cutting angle $\beta$ of about 90°. Under these conditions and provided each grooved segment covers 15° of the circumference of the disk, the number of cutting teeth per cm for each segment 11 will be about 4.1. The angle $\alpha$ of the cutting teeth in relation to the radius Rc through the center line (line of symmetry) of each grooved segment should be within such a narrow range as about 3°–15° or more preferably 5°–10°. It is particularly suggested that this angle $\alpha$ for the above-indicated preferred dimensions of both cutting teeth and segments be 7.5°. The angle $\alpha$ may be positive or negative depending upon the direction of rotation of the disk and is here assumed to be positive if the ridge or cutting tooth intersecting the radius Rc has its outer end located before the terminal point of this radius on the circumference of the disk.

For rational manufacture of the segments and to simplify the determination of the parameters of operation for achieving the desired production result on the basis of performed analyses of the results, the groove configurations for the two cooperating milling disks should be similar, which does not exclude reversing the groove configuration of one disk in relation to that of the other disk. If the angle $\alpha$ for one disk is assumed to be positive, the angle $\alpha$ for the other disk may thus be positive or negative and selected in view of the material to be processed and the desired result of the processing.

If the groove configurations of two disks with the milling surfaces facing in the same direction, as in FIG. 6, are compared, the angle or direction $\beta$ of the cutting teeth may be considered positive ($\beta^+$) for one disk and negative ($\beta^-$) for the other. It will be understood from the above that both faces of the disks may be provided with cutting teeth with the same cutting angle (inclination of cutting teeth in relation to the direction of rotation), i.e. either + or − oppposite cutting tooth angle in relation to each other depending on the selected direction of rotation of one disk in relation to the other. The flank inclination $\beta^+$ or $\beta^-$ of the cutting teeth thus is also selected with regard to the type of milling material and desired final product.

If it is assumed that the above-mentioned angle $\alpha$ is $\alpha_1$ for one milling disk and $\alpha_2$ for the other and that both are positive, the angles of intersection K of the cutting teeth of the two disks during relative rotation thereof will vary between a minimum and a maximum according to the relationship $K=(\alpha_1+\alpha_2)\pm x$ where $\alpha_1$ and $\alpha_2$, respectively, is the shear or cut angle measured in relation to the radius through the center line of the segment and where x is the arc angle of the segment at the center of the disk.

For each angle x, when $\alpha_1=-\alpha_2$, the angle of intersection K will be $\pm$x, resulting in a concordant pulsation, i.e. a pulsation with an equally large number of outward movements and inward movements. Further, the formula $K=(\alpha_1+\alpha_2)\pm x$ is always valid and applies to the following relationship:

when $\alpha_1+\alpha_2$ is $<$x pulsation is always obtained, and if $\alpha_1=\alpha_2$, the inward and outward pulsations will be equally large, but if $\alpha_1$ differs from $\alpha_2$, the inward and outward pulsations will be unequal, when $\alpha_1+\alpha_2 \geqq x$ only outward or only inward movements of angular intersection are obtained and, consequently, only outward or inward pulsations depending on the direction of rotation.

As will be appreciated from the above and the following, a ridge or cutting tooth should, for several reasons, extend radially towards the center of the disk, but this is not an absolute requirement for obtaining pulsation. In special cases, if $-x/2 \leqq \alpha \leqq x/2$ one cutting tooth will always extend radially towards the center, and if $\alpha - |x/2|$, the first cutting tooth will always be parallel to the edge of the segment.

Thus, it should be observed that it is in principle not absolutely necessary that any of the cutting teeth extend radially towards the center.

Tests have shown that the angles $\alpha$ and x should lie within relatively narrow ranges and preferably such that $$-10° \leqq \alpha \leqq 10°$$

$$3.5° \leqq x \leqq 30°$$

and the ridges of the cutting teeth should be parallel to each other and have the same dimensions with respect to the flank angles $\beta_1$ and $\beta_2$ of the cutting teeth, and with respect to the depth d.

In general, the following conditions apply:

If all the ridges extend towards the center of the milling disk and are identical, no outward, inward or pulsating movement will occur but only a jerky passage of the ridges. Only if the ridges are rotating to the right on one disk and to the left on the other, the angles of intersection will give rise fo a pulsation but only on condition that the ridges are so arranged in segments that their angle in relation to the radius is changed stepwise from one ridge to the next from one edge of the segment to the other, as in the segments according to the invention.

If $\alpha_1$ and $\alpha_2$ are 7.5° and x is 15°, $K=(7.5°+7.5°)\pm 15°$, i.e. K varies between 0° and 30°. If, on the other hand, the angles $\alpha_1$ and $\alpha_2$ are 7.5°, but one is positive and the other negative, the angle of intersection K varies according to the relationship $K=(7.5°-7.5°)\pm 15°$, i.e. between −15° and +15° in the case assumed. According to the invention, this fact may be used for adjusting the milling effect.

The cutting teeth on cooperating milling disks according to the invention may, depending on the movements (R/R), (S/S) etc.) performed be considered to be constituted by the edge between the crest surface and either the cutting flank 13 or the rear flank 14 according to the terms used above. The cutting teeth on the cooperating milling disks according to the invention have in a per se known manner the same effect as the cutting edges of a pair of scissors and will thus operate with a varying degree of shearing or cutting effect on the milling material while the milling disks are performing a tearing or grinding operation. For a certain relative direction of rotation of the milling disks, the angles of intersection K between the cutting teeth of cooperating segments will move radially outwards towards or inwardly away from the outer circumference of the disk. For the relative direction of rotation for which the points of intersection K move radially outwards, the cutting teeth act as milling material conveyors tending to transport the milling material radially outwardly with the assistance of the centrifugal force produced by the rotation of the disks. In the opposite direction of rotation, the points of intersection will move radially inwardly and then tend to transport the milling material radially inwardly against the action of the centrifugal force. Depending upon the design of the cutting teeth, the cutting angles and the cooperation of the cutting teeth R/R, S/S or S/R and R/S and depending upon the relative direction of rotation and the speed of rotation, it is thus possible to determine and adjust the force of conveyance and, hence, the time of residence of the milling material between the milling disks.

As appears from the foregoing, a disk mill can be given a plurality of different processing characteristics when using milling disks according to the invention, by combining different parameters, such as S/S, R/R, S/R (R/S) for the movements of the cutting teeth in relation to each other, the angles $\alpha$ and their signs (+ or −), the cutting tooth directions $\beta$ and their signs (+ or −), reversal or not of the groove configuration of one milling disk in relation to the other and by selecting the speed of rotation.

Attention should particularly be drawn to one very interesting property of the milling disks according to the invention. In fact, if the cutting teeth of one disk have a positive and the other a negative cutting angle $\alpha$, such that the cutting teeth of one disk are parallel to the cutting teeth of the other disk throughout the entire circumference of the grooved zone during a short moment when one disk arrives in a conforming angular position in relation to the other, the cutting teeth will operate, as the disks are rotated, alternatingly with radial inward and outward movement of the points K in a rotating pattern of pulsations with instantaneous interruptions and changes at the moment the grooves of one disk pass coinciding angular positions in relation to the grooves of the other disk. Thus, during these short moments, when also the cutting teeth on one disk are parallel to those on the other disk, the grooves in the disks are pairwise facing each other and form open-ended radial channels. The occurrence of this event per revolution equals to the number of segments, when the two disks have an equally large number of segments and the distribution of grooves and ridges is equal and when $\alpha_1$ and $\alpha_2$ for the two disks are equal but of opposite signs. The sum of the negative and positive movements of intersection of the cutting teeth radially outwards and radially inwards in this case in principle becomes zero and the feed takes place radially outwards by the centrifugal force only. The time of processing of the milling material may therefore be determined by choosing the relative speed of rotation of the disks. The milling material between the disks are constantly mixed by being moved by the cutting teeth sideways from one groove to another during the outward movement of feed, this mixing being increased in that the velocity of the radial movement of feed constantly changes in dependence upon the instantaneous speeds and directions of the radial movement of the points of intersection of the cutting teeth and in dependence upon the radial length of the free groove portions, which, as appears from the above, varies between a minimum value, when the points of intersection of the cutting teeth have reached their maximum value, and a maximum value which is equal to the radius of the grooved zone, when the angles of intersection of the grooves attain the zero value. The same applies to milling disks according to the invention, in which one disk operates at the cutting angle $\alpha+$ and the other at $\alpha-$, but with the difference that the angles of intersection of the cutting teeth move either radially outwardly or radially inwardly depending upon the relative direction of rotation of the disks, and with the difference that only a very restricted number of grooves around the circumference of the disk can coincide and form open radial channels throughout the entire radius of the grooved zone. The "opening times" for each such channel, which are dependent upon the relative speed of rotation of the disks, can be used for adjusting the processing and passage times for the milling material and also to affect or adjust the mixing of the milling material during processing. Milling material which tends to be fed outwardly in a radial direction in the channels having opened, will be arrested or decelerated the next moment by cutting teeth intersecting the channels, and moved by the cutting teeth sideways into adjacent grooves where the radial feed rate is lower and the shearing angles of the cutting teeth are larger.

As to the "feed effect" described above, it should be pointed out in particular that it is selective in the sense that the cutting effect becomes most intense on the coarser material and, by an "effect of pulsation", the coarser material will thus be retained until it has been disintegrated.

It is also possible to profit from the above-mentioned properties of the milling disks according to the invention for obtaining pulsating aeration and outblow in the use of milling disks according to the invention, e.g. for hulling.

To further elucidate the effect of the cutting tooth and groove configuration of milling disks according to the invention, it should be noted that the cutting teeth of the cooperating disks define a large number of cells which, during rotation of the disks, will constantly change in respect of shape and size from triangular shape with the base open for feed and discharge, respectively, at the interior and exterior disk circumference, to the shape of closed quadrilaterals. Moreover, a varying number of cells will also periodically form radially open channels in the manner which will have been understood from the above. The corner angles and length of the sides of the cells will change rhythmically and make the cutting and/or rear flanks and cutting edges process and displace the milling material. The radial speed of movement of the points K of intersection of the cutting teeth is different in different disk sectors but in the preferred embodiment the effect of conveyance thereof will be added to and not counteracted by the centrifugal force, although the discharge force on the milling material will vary rhythmically.

For two disks with predetermined grooved zone configurations, for which the most important parameters are the angles $\alpha$ and $\beta$ and their signs, the angle v, the groove depth d and the width of the crest surface 15, the processing time between the disks can be adjusted by selecting a relative speed of rotation for one disk in relation to the other and by selecting a relative direction of rotation.

It is recommended that a number of milling disks with different cutting tooth configurations are kept in stock to allow exchange of disks for processing milling material of different types. By the extensive possibilities of adjustment for each pair of disks, only a relatively small number of disks with different grooved zone configurations need however be kept in stock.

As already mentioned by way of introduction, it has previously been difficult to analyze the effect of the breakdown by the milling means and the reasons for deficient breakdown. The effect of the breakdown for the result of the sifting operation has been difficult to determine since conventional ash and fiber analyses have provided but incomplete information on the content of the different constituents in the respective sifted fraction. A primary reason for this is that it has not been possible on the basis of the results of analysis to relate the ash and fiber content with certainty to the aleurone layer and the hull layer, respectively. A high content of e.g. ash may thus depend on a concentration of hull as well as a concentration of aleurone in the sample. By a grading analysis, in which the particles in a milled sample are divided up according to size, there is obtained no information whatever from which constituents the individual particles derive. The conclusion based on conventional colour, ash and fiber analyses, and grading analyses based on conclusions from the result of a certain breakdown and separation of the botanical components of the cereal or seed kernels, may therefore give rise to incorrect conclusions about optimum setting of the mill and optimum configuration of the milling surfaces. Not until recently has the conventional technique provided sufficiently reliable product analyses which have made it is possible to verify in a reliable way the usefulness of different milling surfaces and their operation at different settings, e.g. for obtaining optimum setting of a particular mill. These improved product analyses, especially the one disclosed in SE patent specification No. 7811307-3, have proved particularly well suited for verifying the results in the use of milling disks according to the present invention. The results achieved with the milling disks of this invention have turned out to be surprisingly good. Also, it is highly surprising that these results have been achieved by means of a groove or cutting tooth configuration that is extremely easy to manufacture.

By the new methods of analysis, it has also been possible to verify the optimum sectoral angles, i.e. the arc angles of the sectors at the disk center, for the cutting segments as well as other parameters.

For purely practical reasons, these sectoral angles should be selected so as to be equal for all segments and so that 360° divided by the number of sectors will give as quotient an integer. The larger the sectoral angles are, the larger become the segments, which means that the number of segments that can be arranged on one milling disk decreases with the size of the sectoral angles, and the angles of intersection of the cutting teeth increase on an average. The smaller the sectoral angles are, the larger becomes the number of segments and the smaller become the angles of intersection of the cutting teeth on an average. It has been found that too large or too small angles of intersection of the cutting teeth make the cutting teeth less efficient. Practical tests and results of analysis have shown that the number of segments should be within the range of 12–48, $\beta_1$ within about 0°–25°, $\beta_2$ within about 45°–75°, and $\alpha$ within about 3°–15°, i.e. the angle each cutting tooth of a segment makes when passing across the radius of symmetry of another segment, depending upon the type of milling or hulling. It has surprisingly been found that optimum results are achieved with $\alpha$ lying within a still more restricted range, such as about 3°–10° and preferably 5°–10°, especially for flour production by means of milling disks according to the invention when the groove configuration agrees with or comes fairly close to the data recommended above for the indicated parameters. Any deviation from these parameters which gives unacceptably poorer milling results may, by the current methods of analysis described, be estimated at ±15% at most. Also, it should be noted that the angle $\alpha$ in milling disks according to the invention with the dimensions indicated above is sufficiently critical to be recommended for such a narrow range as 6°–9°, optimally 7.5°, for bakery meal.

According to the prior art technique, attempts have been made to solve the infeed problem by using a cutting zone with large grooves between the cutting ridges on each disk at the inlet side of the disks. When feeding cereals, for instance, the grooves between the cutting ridges should be sufficiently large to allow the cereal seeds to enter at the radially inner ends of the grooves. However, as stated above, the adjustment of the milling disks is a major problem, whether these known grooved zones alternate or vary stepwise or successively from large to finer grooves.

According to the invention, use is preferably made of a groove and cutting edge configuration which is characterized by grooves mutually equal in width and depth and having mutually equal cutting teeth from the inner circumference of the cutting zone to the outer circumference thereof, and parallel cutting teeth for each segment. In disk mills according to the invention, the feed problem is solved in a simple way by forming the annular grooved zones conical, i.e. the crests 15 of the cutting teeth on each disk are located on a conical surface of rotation with the apex of the cone located on the axis of rotation of the disk in the preferred embodiment, where the feed takes place in a direction from the center and radially outwardly. It should however be noted that the feed might also take place in a radial direction from the outer periphery to the center and, thus, against the centrifugal force by using the feed action of the cutting teeth when the disks are so operating that the points of intersection of the cutting teeth are moving constantly or predominantly inwards and the feeding action thereof exceeds the action produced by the centrifugal force.

It should here be added that a mill according to the invention is operable in all positions and, thus, also with a vertical drive shaft for the disks.

On account of the conicity described above, the gap between the disks is larger at the inlet side than at the discharge side, and of course it should be sufficiently large for the desired infeed. By axial adjustment of one milling disk, preferably the rotatable milling disk, in relation to the other disk, the milling gap can be set in a per se known manner. Since the milling gap is conical, it is possible to achieve, without the need of using a varying groove depth, a sufficiently large inlet at an optimal gap adjustment for any selected degree of milling. In connection with the adjustment, the gap width is uniformly changed throughout the entire radial extent thereof. Since the cutting teeth and the grooves have constant dimensions from the inner periphery of the cutting zone to the outer periphery thereof, the cutting teeth will provide a regular cutting effect throughout their entire length, i.e. the effect of the cutting ridges on the cereals supplied and their effect on the particles successively disentegrated during the movement towards the discharge side will in actual practice be very constant.

The device for adjusting the axially adjustable disk is not shown since any suitable prior art adjusting device for such adjustment of disk mills can be used. Preferably, such adjusting device should be arranged to be operable from outside without having to open the mill housing, but it is practical for various reasons that one side wall of the housing, such as the right-hand wall 17 as shown in FIG. 2, preferably is readily removable or openable as a door. However, a single solution is to arrange the rotary milling disk 5 adjustable by means of a handwheel accessible from the outer side of the mill housing and connected to such disk by means of a transmission device which extends through the wall 18 of the mill housing.

It is conceivable to assemble the circular cutting zone of each disk of a series of segments 11 each of which is made up of a serrated or grooved plate and formed such that the cutting zone assembled is slightly arched instead of solely conical. Preferably, the shape should then be such that the annular grooved facing zones have a larger angle of convergence on the inlet side and become parallel or less conical through a distance on the discharge side for providing a longer distance for fine processing. However, analyses of milled samples have shown that the gain of such a design is questionable because of the somewhat increased cost for producing such segments.

Analyses on samples obtained in milling with different settings of the milling gap and in operation at different speeds of rotation have shown that in disk mills according to the invention, the result of different gap settings is foreseeable and that the results for producing flour are at least equal to those obtained with present-day roller mills. Among the major advantages afforded by the disk mill according to the invention as compared with roller mills, the following ones are especially worth mentioning:

(1) a substantial increase in product yield, complying with specified quality requirements, per time unit for a comparable milling area;

(2) a considerably less bulky and less complicated machine equipment necessitating but a fraction of the space required in conventional roller mills;

(3) considerably reduced costs for investment, operation and maintenance as compared with a roller mill for the same product yield per hour and the same product quality;

(4) the effect of breakdown, i.e. the disintegrating effect, in a disk mill according to the invention is so efficient that it is possible, after the disk mill, to use a considerably simpler bolting equipment provided its capacity matches the fast-operating disk mill according to the invention;

(5) the disk mill according to the invention can easily be adjusted for different types of milling material supplied and for different types of products to be produced. For instance, it can be adjusted relatively easily from dehulling to milling for producing high-quality bakery meal by sifting;

(6) a series of disk mills according to the invention can operate in parallel with each other for industrial large-scale production without necessitating production in several milling steps in series, and the disk mills operating in parallel can be remote-controlled according to programs which because of the fact that the result of different adjustments is predictable, can easily be preselected for obtaining a certain and like product quality for all of the mills operating in parallel, or for different products from one or more of the mills.

The improved results in disk mills according to the invention are so substantial that a comparison with the results achieved in prior-art disk mills are of minor interest. Therefore, as an illustrative example, the following results as listed below are related to a comparison with results achieved in a known roller mill plant comprising three coarse grinding passages and three fine grinding passages, as well as three brushing machines having eight intermediate special sifters. For a capacity of 5 tons/24 h, i.e. about 200 kg/h, it was possible to produce a flour with a yield of about 73% and an ash content of about 0.8%.

This substantial accumulation of machines of a capacity of 200 kg/h is illustrative of roller mills according to the prior art technique.

Further, the following applies to the above-mentioned prior art equipment comprising a series of several roller mills:

| | | |
|---|---|---|
| after | first coarse passage | 16.6% yield |
| | second coarse passage | 35.5% yield |
| | third coarse passage | 43.2% yield |
| | first fine grinding passage | 51.1% yield |
| | first brushing machine | 62.1% yield |
| | second fine grinding | 67.8% yield |
| | third fine grinding | 73.0% yield (ash about 0.8%) |
| | second brushing machine, if any, | 79.7% yield (ash above 1%) |

Results of baking from tests conducted by means of the apparatus according to the invention appear from the accompanying Table of test baking where analyses Nos. AH12 and AD14 relate to flour produced with a yield of about 55–60% from the above-mentioned short sifting system after only one grinding passage.

Analysis 18 is performed with flour from the second coarse passage in a single roller mill. The yield was less than 5%. Analysis No. 20 relates to flour from the first coarse passage in a single roller mill, the yield being less than about 1–2%.

It should be noted that samples Nos. 3 and 4, relating to baking tests with flour received after the first and second coarse grinding, respectively, with a yield of only about 1–2%, merely are of theoretical interest since this flour is not commercially desirable. Test No. 5 relates to common, commercially available household flour obtained with a yield of about 70%. Otherwise, the figures in the Table will be self-explanatory.

TEST BAKING

| Sample No. | Analysis No. | Remark | Flour g | Weight g | Spec. weight g/100 g flour | Volume ml | Spec. vol. ml/100 g flour | Shape acc. to Molin | Porosity acc. to Daltman | Elasticity of crumb | Appearance |
|---|---|---|---|---|---|---|---|---|---|---|---|
| 1 | AH 12 | Short sifting system, | 215 | 348 | | 410 | | 4 | 5 | 5 | 3 |
| | | single milling passage | 219 | | | | | | | | |
| | | flour produced at 55–60% yield | | | 159 | | 652 | | | | |
| 2 | AD 14 | Short sifting system, | 201 | 334 | | 405 | | 5 | 5 | 5 | 4 |
| | | single milling passage | 205 | | | | | | | | |
| | | flour produced at 55–60% yield | | | 163 | | 660 | | | | |
| 3 | 18 | 2 coarse passages | 240 | 373 | | 290 | | 4 | 6 | 5 | 4 |
| | | in roller mill | 245 | | | | | | | | |
| | | yield < 5% | | | 152 | | 441 | | | | |
| 4 | 20 | 1 coarse passage in roller mill | | | | — | | 3 | — | — | — |
| | | yield about 1–2% | | | 156 | | 475 | | | | |
| 5 | 24 | Commercial household flour from roller mill; | | | | | | 3 | 3 | 5 | 2 |
| | | yield about 70% | | | | | 450 | | | | |

In the foregoing, the milling disks according to the invention have been described as substantially planar or slightly conical, but the invention is also applicable to more pronouncedly conical milling surfaces.

Figure 9:
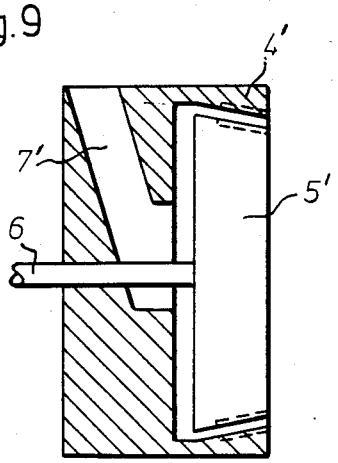
FIG. 9 is a schematic view of a mill which comprises distinct conical milling disks of the stator and rotor type but equipped with milling segments according to the invention and designed for the same type of milling cooperation as the milling disks in FIGS. 1–8.

If it is assumed that the conicity of the rotary milling disk 5 and its grooved zone 10 in FIG. 2 is further increased and that the conicity of the fixed milling disk 4 is reversed and increased, i.e. such that the apex of the cone is displaced to the left in FIG. 2, a conical disk mill is obtained, which still has substantially the same character and the same possibilities of adjustment as the mill described above, i.e. as the disk mill schematically illustrated in FIG. 2. A further change of the cone angles in the indicated direction will result in the design of FIG. 9. In this embodiment, the rotary disk is in the form of a conical rotor 5' and the stationary disk in the form of a conical stator 4'. The feed is effected through a channel 7' opening in the mill housing at the base side of the rotor and the discharge takes place circumferentially with respect to the small side of the rotor. Of course, the feed may instead take place at the small side and the discharge at the broad side (base side of the rotor). In FIG. 9, the drive shaft 6 is illustrated as a horizontal shaft, but the conical disk mill in FIG. 9 is particularly well suited for a vertical arrangement of the shaft with the small side of the rotor facing downwards. Again, it should be pointed out that either arrangement is possible, both for a disk mill according to FIG. 9 and for a disk mill according to FIG. 2.

According to the invention, the grooved zones 10 with their milling segments in the disk mill of FIG. 9 in principle have the same configuration as described with reference to FIGS. 4–8, and the principle of operation is the same, i.e. during operation of the disk mill according to the invention the entire milling area is constantly working as opposed to roller mills in which only linear contact zones of the total milling areas of the rollers cooperating perform effective work.

As appears from FIG. 9, it is possible in the typical conical disk mill to use a conical rotor having a small axial dimension in relation to the radius of the rotor, e.g. being one third of the radius, and the same ratio may in principle be used for the radius of the grooved and toothed cutting zone in relation to the disk radius in disk mills of the type illustrated in FIG. 2. The reason for selecting such a short processing zone for the milling material in disk mills according to the invention simply is that the mill operates so efficiently that a larger processing zone is not required for "normal" disk diameters, as in the disk diameter range of 400–700 mm. If milling disks of a diameter of substantially less than 400 mm are used, the radius of the cutting zone in relation to the total disk radius can be increased but if, on the other hand, larger milling disks are used, the radius of the cutting zone can be reduced in relation to the disk radius. The same applies to the conical disk mill in FIG. 9 with the difference that it is here a matter of the ratio of the disk radius to the axial length of the conical cutting zone.

It should be noted that the conicity described above in connection with milling disks according to the invention is most advantageous since it overcomes the critical problem of adjustment in the case of planar milling disks. In fact, it has been found that the conicity may vary within fairly wide ranges without any detrimental effect on the milling result. The feed inlet is chosen according to the milling material such that the material will be effectively received. Grains with pointed ends, which is the most common shape of grains, are then so oriented that the pointed end is directed towards the milling gap in the direction of the grooves.

As earlier mentioned, it is possible in connection with disk mills according to the invention to use a simplified sifting apparatus. A particularly simple and practical sifting apparatus is schematically illustrated in FIG. 1. This sifting apparatus which, as indicated above, is generally designated 2, is connected through a conduit 20 to the outlet of the disk mill 1, which extends from the outer circumference of the mill housing. For transport to the sifting apparatus, pneumatic or mechanical conveyance can be used. The sifting apparatus may be a centrifugal bolter 21 having a bolting cloth means **21*a*–21*c* selected with respect to the fineness of the final flour. The bolting cloth means may comprise a number of similar or different cloths 21*a*–21*c*. Normally, the bolting cloths are selected in such an order that the cloths 21*a* have a mesh of e.g. 180 μm and the cloths 21*b*–21*c* a mesh of 150 μm. Through outlets 22*a*, 22*b* from these sifting stages, the most valuable product, i.e. the purest and best flour from the first sifting stage or stages, is withdrawn and discharged from the sifting apparatus through a conduit 23*a*. Also from the immediately following sifting stage, a high-quality flour product is withdrawn through an outlet conduit 23*b***.

Particles which cannot pass through the bolting cloths **21*a*–21*c*, such as hull parts and coarser endosperm particles, are conducted to the outlet 24 and can be transported to a second centrifugal bolter 25 or to the other side of the sifting apparatus 21, if it is a double centrifugal bolter. The second bolter or second side of the sifting apparatus is provided with a number of bolting cloths 25*a*–25*c* from which two products passing through the cloths and consisting of smaller hull parts and larger endosperm particles are withdrawn. The product portion which cannot pass through the bolting cloths 25*a*–25*c* is discharged as a residual product through the outlet (drum) 27 and consists of relatively coarse hull parts and a small amount of relatively coarse endosperm particles. This residual product can be sifted in a wind or suction sifter with separate outlets 29, 30 for separating the coarser endosperm particles from said hull parts. The products leaving through the outlets 26*a*, 26*b* and, possibly, 30**, may either be used directly as pollard or fodder meal or be subsequently treated in a suitable finishing apparatus, for instance a grain polishing machine, by means of which small hull part fractions are removed from endosperm particles, and clean grains, semolina, are recovered. These clean endosperm particles can thereafter be ground in a milling apparatus.

Figure 10:
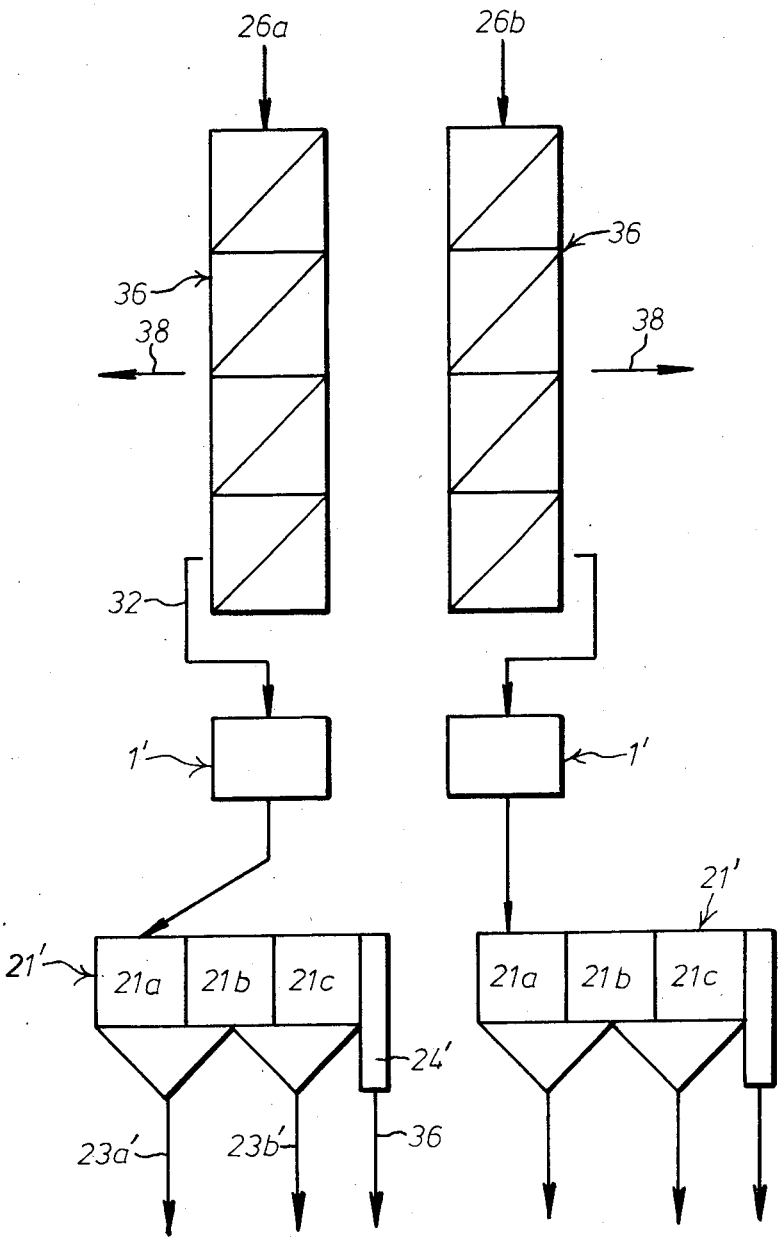
FIG. 10 is a schematic representation of a milling system.

FIG. 10 however schematically shows a system for subsequent treatment which is connected to the outlets **26*a*, 26*b* and possibly also to the outlet 30 in FIG. 1 and lengthens the "short" sifting system in FIG. 1. From the outlets 26*a*, 26*b*, the accepts, which mainly consist of endosperm particles and small hull part fractions usually adhering thereto, are withdrawn from the sifting apparatus 25. These products are first transported to cleansing or fractionating apparatuses 36 which may comprise several stages connected in series to each outlet 26*a*, 26*b*. As such apparatuses or stages may be used relatively simple, conventional apparatuses which are capable of separating the hull fragments from the endosperm particles and from which the rejects are discharged as bran through outlets 38, clean endosperm grains, i.e. semolina, being obtained as accepts. These clean endosperm particles are conducted, e.g. through the conduit 32, to the disk mill in FIG. 1 or to any other milling apparatus 1' (FIG. 10) which preferably is a disk mill according to the invention or a conventional roller mill stage. If a disk mill according to the invention is used, it may be advantageous to use disks having finer grooves than those employed for the general flour production, e.g. a number of grooves exceeding the about four grooves per centimeter which in averagesize milling disks according to the invention have proved to yield excellent milling results in the production of bakery flour. If no disk mill is available but only a roller mill, this may of course be used. The products from the mills 1' are transferred to a sifting apparatus 21' which may be of the same type as the sifting apparatus 21 in FIG. 1**.

In the use of a disk mill and a "short" sifting equipment of the type described above (FIG. 1), i.e. a disk mill according to the invention and a double or two single centrifugal bolters 21/21 or 21, 25, a production rate of 1 ton/h (wheat) may readily be achieved and a flour yield of about 60%, which is a highly remarkable result considering that the plant as a whole is extremely simple and highly compact as compared with conventional roller mill and sifting plants and requires but a fraction of the investment costs of the latter plant for a corresponding capacity.

By the use of the "long" sifting and subsequent treatment system described above with reference to FIG. 10, i.e. a system in which the accepts from the sifting apparatus 25 are transferred to an apparatus 36 for separating hull residues, and the accepts from the apparatus 36 are subjected to additional milling, the flour yield may be increased to about 75–80% for the same production capacity, i.e. about 1 ton/h.

The quality of the flour received from the sifting apparatus 21 or 21, 21' has been found to be as high as that of flour obtained in roller mills, both with respect to ash content and colour according to the above-mentioned current method of analysis. As regards the baking characteristics of the flour, this will give at least the same or even a larger bread volume than conventional flour from roller mills.

Figure 11:
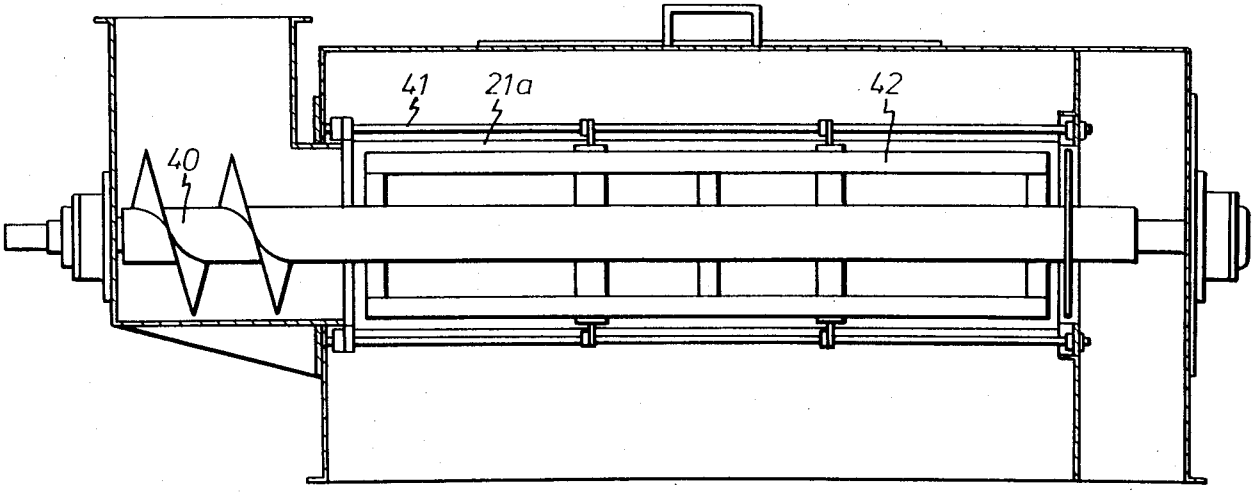
FIG. 11 is a schematic representation of a centrifugal bolter.

FIG. 11 schematically illustrates an example of a preferred centrifugal bolter which may be used in the sifting apparatuses 21, 25 and 21' described above. This centrifugal bolter, which has proved to have a very high capacity and low energy consumption, in principle operates in the following manner.

The milled product is fed by means of a short feed screw 40 into a bolting cylinder 41 in which the milled material is caused to rotate and be flung against the cylindrical bolting cloth, e.g. **21*a* in FIG. 1, by means of rotor blades 42. The accepts passing through the bolting cloth are transferred to an outlet, e.g. the outlet 23*a* in FIG. 1, and the rejects are transferred to a rejects outlet, e.g. the outlet 24 in FIG. 1**.

The bolting cloth or mesh, e.g. **21*a***, is fixed by clamping rings and is allowed to vibrate relatively freely so as to be automatically cleaned. The bolting mesh may consist of any suitable material, such as nylon or metal wire, and is readily exchangeable. It should be added that a sifting apparatus of the type described above is very compact in relation to its capacity.

It goes without saying that many modifications and variations which have not been described above or illustrated in the drawings but which are evident to anyone of ordinary skill in the art, are conceivable within the spirit and scope of the instant invention.

What I claim and desire to secure by Letters Patent is:

1. Apparatus for producing, by processing cereals, such as grain, a siftable product, especially a product suited for flour production by subsequent sifting, said apparatus comprising at least one pair of cooperating processing members having serrated disintegrating zones for treating said cereals therebetween and, in the case of flour production, devices for sifting the product produced by said cooperating members, said members, at least one of which is rotatable, having a common axis of rotation, and the serrated zone of each of said cooperating members being circular and composed of a series of segments forming cutting teeth alternating with parallel grooves, each of which has a serrate pattern composed of a plurality of ridges forming cutting teeth alternating with parallel grooves, each of said cooperating processing members, at least on one side thereof, has an annular serrated zone having inner and outer perpheries and composed of segments each having a serrate pattern of cutting teeth and grooves extending in parallel throughout the width of said segment from the inner periphery to the outer periphery of said annular serrated zone, said teeth having a constant and mutually equal height and mutually equal width, and said grooves between the cutting teeth having a substantially constant and mutually equal width and mutually equal depth, each cutting tooth being in the form of an elongated ridge having a crest surface (15) and, on either side thereof, two opposite longitudinal flank surfaces which make different angles in relation to a plane along the cutting tooth perpendicular to the base thereof, and in that said cutting teeth are so designed that during relative rotation of said processing members when in operation, one of the cutting teeth of each segment of each of said cooperating zones of each of said processing members intersects a line of symmetry for each of said segments of the other of said cooperating zones at an angle $\pm\alpha_1$ for the serrated zone of one processing member and $\pm\alpha_2$ for the serrated zone of the other processing member, said angle $\alpha$ being positive on one side and negative on the opposite side of said line of symmetry, and further in that at least the first cutting tooth at one end of each segment of one of said processing members during movement past the opposite teeth of each segment of the other processing member will intersect the last-mentioned cutting teeth at angles of intersection K which vary according to the relationship $K=(\alpha_1+\alpha_2)\pm X°$ where K is the angles of intersection of the opposite cutting teeth in relation to each other, $\alpha_1$ and $\alpha_2$ represent said angle, positive or negative, which a cutting tooth of each segment of one or the other of the processing members makes in relation to the line of symmetry of said segment, and x is the sectoral arc angle of the segment.

2. Apparatus as claimed in claim 1, characterized in that each of said cooperating processing members has a single serrated zone (10) and that the two processing members and their serrated zones are so formed and positioned in relation to each other that the processing gap therebetween is widened in a direction away from the discharge side of the serrated zones towards the inlet side thereof and that each serrated zone coincides with a geometrical frusto-conical surface the center of which is situated on the common axis of rotation of said processing members, and in that each serrated zone has a width, i.e. radial dimension, which is substantially equal to $\frac{1}{3}$ of the radius of the processing member from said axis to the outer circumference of the serrated zone, and further in that said sifting device comprises centrifugal and wind sifters (2).

3. Apparatus as claimed in claim 1, characterized in that for a flank angle ($\beta_1$) of between 0° and 25° for one flank of each cutting tooth, the flank angle ($\beta_2$) for the other, opposite flank of the cutting tooth is between 45° and 75°.

4. Apparatus as claimed in claim 1, characterized in that the spacing of the grooves of each of the serrated zones (10) of at least each side of each processing member is such that the number of grooves and ridges, respectively, amounts to about 3–12 per cm of the circumference of said zone.

5. Apparatus as claimed in claim 1, characterized in that the processing members have the form of typical milling disks but differ from planar circular milling disks in that at least said serrated zones coincide with frusto-conical geometrical surfaces.

6. Apparatus as claimed in claim 1, characterized in that the processing members are in the form of conical rotors one of which is rotatable and the other is stationary or rotatable, said rotors being of the typical cone mill type.

7. Apparatus as claimed in claim 1 wherein an absolute value of the angle $\alpha$, is selected to be within the range of 3°–15°.

8. Apparatus as claimed in claim 1 wherein an absolute value of the angle $\alpha$ is selected to be within the range of 5°–10°.

9. Apparatus as claimed in claim 1, characterized in that for flour production with a high flour yield, it comprises, in addition to a first sifting apparatus (21) for sifting the milled siftable product, a second sifting apparatus (25) for receiving rejects from said first sifting apparatus, and an apparatus (36, 1', 21') for receiving and treating accepts from said second sifting apparatus, said apparatus for said treating of accepts from said second sifting apparatus comprising a device (28 or 36) for separating hull particles from said accepts.

10. Apparatus as claimed in claim 9, characterized in that said apparatus for receiving and treating rejects from said second sifting apparatus (25) is an apparatus (28) for removing and separating hull particles from larger endosperm particles.

11. Apparatus as claimed in claim 9, characterized in that said apparatus for receiving and treating rejects from said second sifting apparatus comprises a hull removing and separating device (36), a second milling apparatus (1'), for carrying out additional milling of the accepts from said hull removing and separating device, and a further sifting apparatus (21') for sifting the product from said second milling apparatus (1').

* * * * *

UNITED STATES PATENT AND TRADEMARK OFFICE

CERTIFICATE OF CORRECTION

PATENT NO. : 4,667,888

DATED : May 26, 1987

INVENTOR(S) : Michael Andersen

It is certified that error appears in the above-identified patent and that said Letters Patent is hereby corrected as shown below:

Column 7, line 42, "$\alpha - \left|\frac{x}{2}\right|$" should be --$\alpha = \left|\frac{x}{2}\right|$--.

Signed and Sealed this

Twentieth Day of October, 1987

*Attest:*

DONALD J. QUIGG

*Attesting Officer*

*Commissioner of Patents and Trademarks*